United States Patent [19]

Dubach

[11] 3,966,204

[45] June 29, 1976

[54] ELASTIC TYPE EXERCISING APPARATUS

[76] Inventor: Werner Dubach, Illnauerstrasse 32, CH-8307, Effretikon, Switzerland

[22] Filed: Jan. 12, 1973

[21] Appl. No.: 323,154

[30] Foreign Application Priority Data

Jan. 13, 1972 Switzerland ..... 467/72
Nov. 17, 1972 Switzerland ..... 16761/72

[52] U.S. Cl. ..... 272/135; 272/68; 272/72; 272/71; 272/73

[51] Int. Cl.[2] ..... A63B 23/00; A63B 21/00; A63B 23/04

[58] Field of Search ..... 272/82, DIG. 4, 72, 272/71, 70, 67, 57 R, 83 R, 81, 61, 68, 73; 128/134; 46/175 R; 273/1 R, 159

[56] References Cited

UNITED STATES PATENTS

| | | | |
|---|---|---|---|
| 588,017 | 8/1897 | Sandow | 272/82 |
| 605,237 | 6/1898 | Spink | 272/82 |
| 691,295 | 1/1902 | Schneider | 272/82 |
| 740,443 | 10/1903 | Korth | 272/68 UX |
| 3,454,274 | 7/1969 | Kaneshiro | 272/57 R |
| 3,529,820 | 9/1970 | Templeton | 272/82 |
| 3,531,113 | 9/1970 | Sherman et al. | 272/82 |
| 3,606,321 | 9/1971 | Macoulis | 272/82 |
| 3,807,730 | 4/1974 | Dalton et al. | 272/68 |

FOREIGN PATENTS OR APPLICATIONS

| | | | |
|---|---|---|---|
| 473,909 | 3/1929 | Germany | 272/82 |
| 628,340 | 8/1949 | United Kingdom | 272/82 |

*Primary Examiner*—Richard C. Pinkham
*Assistant Examiner*—William R. Browne
*Attorney, Agent, or Firm*—Neil F. Markva

[57] ABSTRACT

Fitness apparatus for the performance of gymnastic exercises based on stress and relaxation has a plurality of tough elastic ring-shaped hand grips, and connector including at least one endless elastic tensile element connected to two of said ring-shaped hand grips by being passed through each such hand grip and formed into a knot. In a preferred use, at least one other of the hand grips is engaged with the connector intermediate the first two hand grips, e.g. by means of a knot. The hand grips are preferably of rubber like material, and may have an I-shaped cross-section with convex inner and outer peripheral surfaces, to improve gripping with the hand.

6 Claims, 18 Drawing Figures

Fig.1
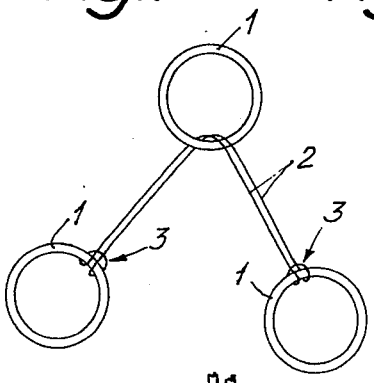
Fig.4
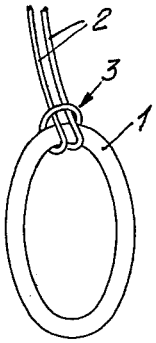
Fig.3
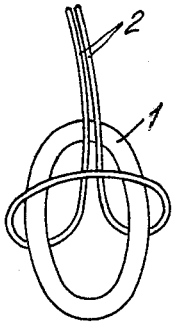
Fig.2
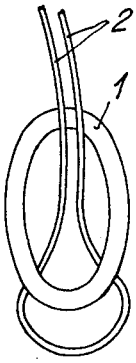
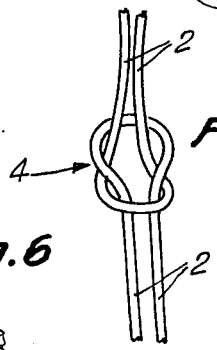
Fig.5
Fig.6
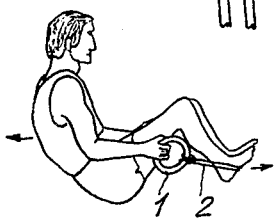
Fig.7
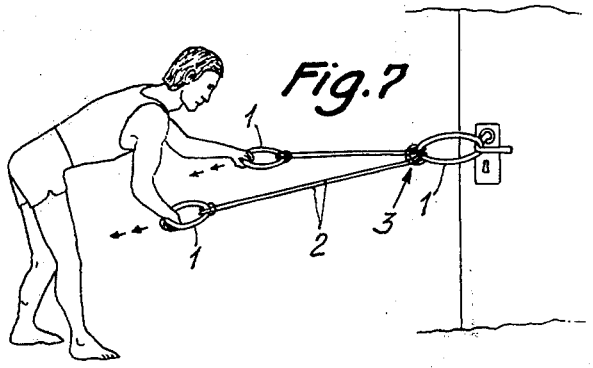
Fig.8
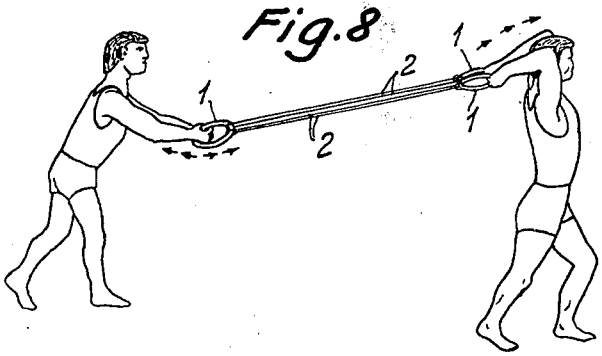
Fig.9
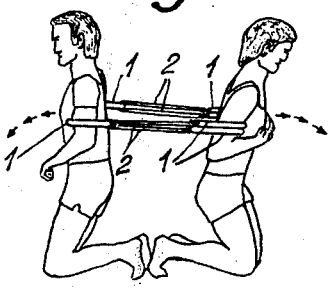

Fig.10
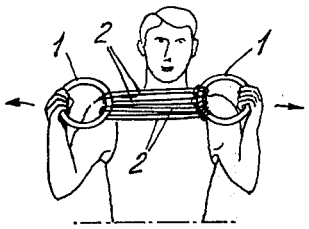
Fig.11
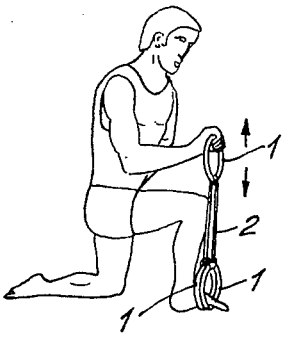
Fig.12
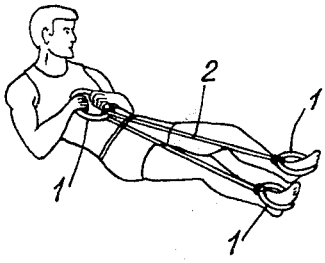
Fig.13
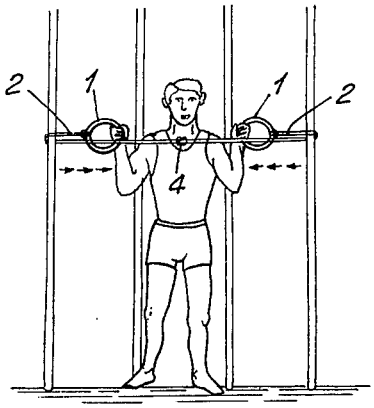
Fig.14
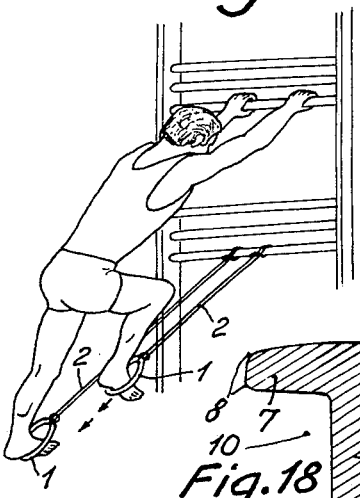
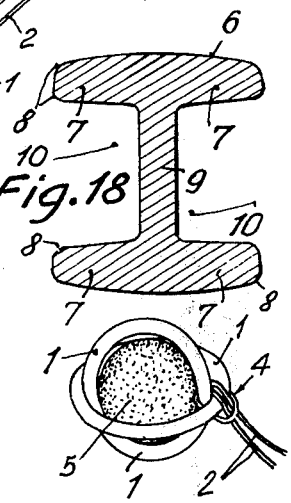
Fig.18
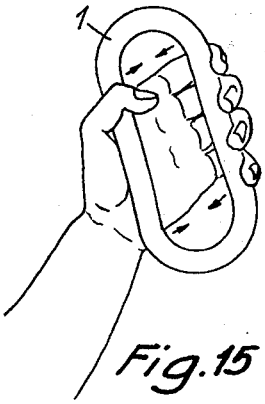
Fig.15
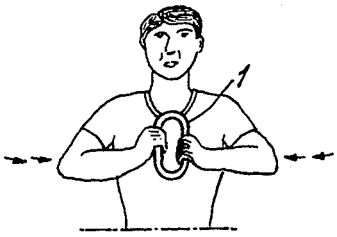
Fig.16
Fig.17

ELASTIC TYPE EXERCISING APPARATUS

SUMMARY OF THE INVENTION

The invention relates to a fitness apparatus for the performance of gymnastic exercises based on stressing and relaxing the muscles. The new apparatus differs from known instruments of this kind in that it is formed of a set of detachably connected tough elastic ring-shaped hand grips. When in use, at least two of the ring-shaped grips are detachably connected without special accessories by at least one endless elastic tensile element or cord which can be knotted.

An additional hand grip can be passed over one of the other two hand grips when they are compressed and can be attached either loosely or rigidly to the tensile element. The whole assembly is of such a nature that, by altering the position of the hand grips, and by pulling them apart while at the same time making use of the tensile element, a wide variety of gymnastic exercises can be performed at will. By fitting the additional hand grip to the tensile element and by doubling and extending the latter, the range of exercises can be extended and the traction forces modified.

Using the fitness apparatus of this invention, a wide variety of gymnastic exercises such as calisthenics, floor exercises, and physical exercises including light to heavy athletics can be performed. Consequently, anyone can prepare for all existing sporting activities, training, balancing sport, such as weightlifting, mountaineering, climbing (strengthening of the fingers), skiing, (long distance, downhill, slalom), swimming, ice sports, cycling, rowing, etc.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 1 the basic apparatus consisting of three rings and an elastic element detachably connected to them, FIGS. 2 - 4 three stages of the securing process showing the detachable linking of the tensile element to a ring, FIG. 5 the extension of the tensile element by detachable connection of two single tensile elements to one another, FIG. 6 the apparatus used as a rowing machine, FIG. 7 the apparatus used for arm and shoulder exercises, FIGS. 8 and 9 partner exercises with one or two instruments, FIGS. 10 and 11 the apparatus used as an expander, FIG. 12 arm exercises with the apparatus shown in FIG. 1, FIG. 13 arm exercises with the apparatus secured to climbing poles, FIG. 14 securing of the apparatus to wall bars and its use for running training FIG. 15 a ring used to strengthen the muscles of the arms and hands, FIG. 16 one or several rings used to strengthen the muscles of the arms, and FIG. 17 use of the apparatus in conjunction with a spherical body for the performance of further gymnastic exercises, FIG. 18 a section through a variation of the hand grip.

DESCRIPTION OF SPECIFIC EMBODIMENTS

The basic apparatus shown in FIG. 1 comprises three ring-shaped hand grips 1 and a tensile element 2 which is detachably connected to them. The apparatus may be used in duplicated form or can be extended by means of further parts thereof. The apparatus is for the performance of the exercises illustrated and discussed hereinbelow. The rings or hand grips 1 consist of tough elastic material and can be solid or hollow in cross-section. They should preferably be made of elastic plastic material or rubber.

The tensile element 2 consists of a rubber cord or rubber-elastic cable which is endless. Element 2 may be manufactured into endless form by means of a fixing and mechanical joint and turned in on itself. The detachable connection 3 between the rubber cord or element 2 and one ring 1 is made in the fixing or tying stages shown in FIGS. 2 to 4. It is possible in this way to secure one ring 1 to each end of the tensile link or element 2.

By passing one of the two rings 1 through a third ring 1, a loose arrangement of the third ring in the center of the tensile link 2 is possible. See particularly FIGS. 1, 8, 9, 11 and 12. When used in accordance with FIG. 7, it is necessary to loop or tie the third ring in the center of the tensile link 2. Tying or looping of the third ring 1 is in accordance with the same procedure shown in FIGS. 2 to 4 to achieve a rigid connection 3. Should a longer rubber cord be required for certain exercises, two standard cords 2 are simply joined together by the interlooping connection 4 as shown in FIG. 5.

The use of the apparatus with two rings 1, joined by one or more rubber cords 2, permits the performance of gymnastic exercises for training for rowing. See FIG. 6. The tensile forces of the apparatus of FIG. 1 may be increased by fitting further elastic cords 2. Three rings 1 may be connected together by one or more rubber cords 2 as shown in FIG. 7. The third ring 1 fits over a door handle permitting arm and shoulder exercises for the purpose of training for swimming.

Two-man exercises may be performed with the basic apparatus of FIG. 1 having three rings 1 to strengthen the upper extremities and shoulder muscles in preparation for throwing the javelin. See FIG. 8. The effectiveness of the exercise can be enhanced by increasing the number of tensile cords. Two basic apparati can also be used for two-man exercises as shown in FIG. 9. The partners kneel back-to-back with their arms through the rings and perform forward bending exercises. Thus, the stomach and leg muscles can be strengthened.

As shown in FIGS. 10 and 11, expander exercises can be performed by using the equipment with two rings 1 connected one another by, for example, two tensile elements 2. FIG. 12 shows the use of the basic apparatus of FIG. 1 with one or more tensile cords 2 and three rings 1 connected thereto. The feet are placed in the two outer rings 1 while the center ring 1 is held in both hands. When the apparatus is used in this way, the tensile cords 2 can be doubled over as shown in FIG. 10 and at the same time shortened. This exercise then requires greater exertion and an appropriately adjusted positioning of the body.

FIG. 13 shows the apparatus being used with two rings on climbing poles for strengthening the muscles of the arms. The lengthened tensile element 2 is made up of two single cords joined by a loop connection 4 as shown in FIG. 5.

For the exercise shown in FIG. 14, two rings 1 and two tensile cords 2 are used. The tensile cord 2 is looped at one end to one of the wall bars. The feet are then inserted in the two rings 1 looped to the other ends of the tensile cords 2. This exercise is intended mainly for running training and stresses the leg muscles, heart and circulatory organs.

FIG. 15 shows the rings 1 being used by themselves for strengthening the muscles of the fingers and hands by compressing the elastic rings. This is good preliminary training for climbing.

In FIG. 16, the elasticity of one of the rings 1 is utilized by pressing them together. Shock stressing of both arms is used against one another. This exercise is for strengthening the arm muscles whereby one, two or three rings can be used together thus permitting graduation of the force required.

FIG. 17 shows a further principle of application. Here, a sphere or a round stone 5 is held in two crossed rings 1 which are looped at one of the crossover points to one or two common tensile elements 2. With this equipment, various additional exercises can be performed.

As shown in FIG. 18, the hand ring 1 can be of double I-section. The I-section is taken on a plane including the axis of the ring. The peripheral surfaces 6 of the web 7 are convex and the corners 8 are rounded. The grooves 10 are opposite one another and located adjacent to the flange 9. Grooves 10 enable the hand grips 1 to be firmly gripped in the hand and prevent undesirable slipping such as would occur with a smooth surface. The hand grip 1 can be of a shape other than an actual ring and can also be made of a suitable plastic material. In the latter case, the version shown in FIG. 18 is particularly suitable.

The exercises described above represent only some of the possible principles of application. The number and variety of the exercises possible is dependent on the use of the appropriate number of rings and tensile elements, it being possible to shorten the latter by doubling them over or to lengthen them by looping them together, thereby at the same time affecting the force required to be exerted.

The expression gymnastic exercises also covers what are known as isometric applications for building up strength and also dynamic uses for improving the circulation and endurance.

I claim:

1. Fitness apparatus for the performance of gymnastic exercises based on stress and relaxation, said apparatus comprising:

a. a plurality of tough elastic ring-shaped hand grips, b. connector means including at least one endless elastic tensile element connected to two of the ring-shaped hand grips by being passed through each said two hand grips and formed into a knot, c. said two hand grips being engaged one within the other with their planes approximately at right angles with respect to each other and connected at one of their points of contact by said tensile element knotted about said rings, and d. a spherical weight disposed within both said two hand grips.

2. Fitness apparatus for the performance of gymnastic exercises based on stress and relaxation, said apparatus comprising:

a. a plurality of tough elastic ring-shaped hand grips having a structural configuration effective to be compressed by hand and thereby usable separately for hand squeezing exercises, and b. connector means for detachably connecting at least two of the ring-shaped hand grips, c. said connector means including at least one endless closed loop, elastic tensile cord detachably connected to each said two ring-shaped grips by being passed through each said two hand grips and formed into a knot.

3. An apparatus as defined in claim 2 wherein a third said ring-shaped hand grip engages a single tensile cord at an intermediate location between said two detachably connected hand grips.

4. An apparatus as defined in claim 3 wherein the elastic tensile cord is knotted about the third hand grip.

5. An apparatus as defined in claim 2 wherein said hand grips are composed of a rubber-like material and the cord is composed of rubber.

6. An apparatus as defined in claim 2 wherein each hand grip is of I-section taken on a plane including the axis of the ring, the inner and outer circumferential surfaces of the I-section being convex in said plane.

* * * * *